US007059379B2

(12) United States Patent
Lewis, Jr. et al.

(10) Patent No.: US 7,059,379 B2
(45) Date of Patent: Jun. 13, 2006

(54) LOW HEAD ROOM OVERHEAD DOOR SYSTEM WITH ADJUSTABLE SHORT RADIUS TRACK SECTION

(75) Inventors: Richard J. Lewis, Jr., Loveland, OH (US); Jeffrey W. Stone, Lebanon, OH (US); Thomas E. Youtsey, Wilder, KY (US)

(73) Assignee: Clopay Building Products R&D Company, Inc., Mason, OH (US)

( * ) Notice: Subject to any disclaimer, the term of this patent is extended or adjusted under 35 U.S.C. 154(b) by 0 days.

(21) Appl. No.: 10/423,439

(22) Filed: Apr. 25, 2003

(65) Prior Publication Data

US 2003/0213566 A1 Nov. 20, 2003

Related U.S. Application Data

(60) Provisional application No. 60/375,348, filed on Apr. 25, 2002.

(51) Int. Cl.
*E05F 15/00* (2006.01)

(52) U.S. Cl. ..... 160/191; 49/200; 16/401

(58) Field of Classification Search ..... 160/209, 160/201, 191, 192; 49/197, 200; 16/401, 16/197

See application file for complete search history.

(56) References Cited

U.S. PATENT DOCUMENTS

| | | | | |
|---|---|---|---|---|
| 1,012,849 A | | 12/1911 | Hedwall | |
| 1,200,639 A | | 10/1916 | Moore et al. | |
| 1,990,870 A | | 2/1935 | Kelly | 20/20 |
| 2,032,768 A | | 3/1936 | Rowe | 20/20 |
| 2,045,060 A | | 6/1936 | Wheatley | 20/20 |
| 2,064,470 A | | 12/1936 | Heckman | 20/20 |
| 2,075,716 A | | 3/1937 | Harrison | 20/20 |
| 2,264,642 A | | 12/1941 | Rowe | 20/20 |
| 2,266,707 A | | 12/1941 | Goodman | 20/20 |
| 2,276,976 A | * | 3/1942 | Howell et al. | 160/209 |
| 2,329,443 A | | 9/1943 | Rowe | 160/209 |
| 2,330,670 A | | 9/1943 | Black | 160/232 |
| 2,391,845 A | | 12/1945 | Rowe | 160/201 |
| 2,412,910 A | * | 12/1946 | Rowe | 160/209 |

(Continued)

FOREIGN PATENT DOCUMENTS

| | | | |
|---|---|---|---|
| CA | 657377 | 2/2002 | 108/4 |

(Continued)

OTHER PUBLICATIONS

Clopay, *Single Rack Low Headroom Supplemental Instructions* , Instruction Brochure, 12 pgs., 2002.

*Primary Examiner*—Blair M. Johnson
(74) *Attorney, Agent, or Firm*—Wood, Herron & Evans, LLP

(57) ABSTRACT

A universal overhead door system includes a pair of horizontal track members, a pair of vertical track members and a pair of track radius members interconnecting the horizontal and vertical track members. A pair of adjustable short radius members extend from the track radius members to guide uppermost rollers of an overhead sectional door. The overhead door system includes a pair of stationary sheaves positioned outboard of a pair of horizontal support rails which support the horizontal track members. A detent is provided at one end of the adjustable radius members to prevent undesirable travel the garage door. A spacer is provided for use in extension spring configurations when a long horizontal support rail is required. The spacer prevents metal-to-metal contact of moveable sheaves with the horizontal support rails.

24 Claims, 6 Drawing Sheets

U.S. PATENT DOCUMENTS

| | | | | | |
|---|---|---|---|---|---|
| 2,436,006 | A | * | 2/1948 | Kaiser | 160/191 |
| 2,604,162 | A | | 7/1952 | Hickling et al. | 160/201 |
| 2,966,212 | A | | 12/1960 | Fimbel, Jr. | 160/193 |
| 2,991,496 | A | * | 7/1961 | Wolf et al. | 16/94 R |
| 3,021,896 | A | | 2/1962 | Buono et al. | 160/113 |
| 4,082,133 | A | * | 4/1978 | Halopoff | 160/191 |
| 4,119,133 | A | | 10/1978 | Wolf | 160/209 |
| 4,379,478 | A | | 4/1983 | Lichy | 160/35 |
| 4,878,529 | A | | 11/1989 | Hormann | 160/201 |
| D337,042 | S | | 7/1993 | Lin et al. | D8/349 |
| 5,240,216 | A | | 8/1993 | Lin et al. | 248/300 |
| 5,247,769 | A | * | 9/1993 | Becker | 52/506.06 |
| 5,263,594 | A | * | 11/1993 | Bianchi | 211/105.2 |
| 5,404,927 | A | | 4/1995 | Bailey | 160/201 |
| 5,425,409 | A | | 6/1995 | Guia | 160/201 |
| 5,615,723 | A | * | 4/1997 | Carper | 160/191 |
| 5,992,497 | A | | 11/1999 | Jaehnen et al. | 160/201 |
| 6,006,814 | A | | 12/1999 | Dalpe | 160/116 |
| 6,047,761 | A | * | 4/2000 | Jaehnen et al. | 160/201 |
| 6,073,674 | A | | 6/2000 | Hormann | 160/201 |
| 6,076,589 | A | | 6/2000 | Hormann | 160/201 |
| 6,089,304 | A | | 7/2000 | Mullet et al. | 160/209 |
| 6,094,779 | A | | 8/2000 | Young | 16/92 |
| 6,227,281 | B1 | | 5/2001 | Martin | 160/201 |
| 6,328,091 | B1 | | 12/2001 | Whitley | 160/201 |
| 6,527,035 | B1 | | 3/2003 | Hoofard et al. | 160/201 |

FOREIGN PATENT DOCUMENTS

| | | |
|---|---|---|
| DE | 3602520 A1 | 7/1987 |
| WO | WO 96/36784 | 11/1996 |

* cited by examiner

LOW HEAD ROOM OVERHEAD DOOR SYSTEM WITH ADJUSTABLE SHORT RADIUS TRACK SECTION

The present application claims the benefit of U.S. Provisional Application Ser. No. 60/375,348, filed Apr. 25, 2002, the disclosure of which is hereby incorporated by reference in its entirety.

FIELD OF THE INVENTION

The present invention relates generally to overhead door systems and, more particularly, to an overhead door system for use in low head room environments.

BACKGROUND OF THE INVENTION

Overhead garage door systems are widely used in both residential and commercial applications, and are designed to be operated either manually or automatically through a reversible motor. Overhead garage doors include a series of interconnected door panels that are connected along their longitudinal edges by one or more hinges to provide pivotal movement of the door panels between vertical and horizontal positions as is known in the art. The door panels include a series of roller brackets mounted on opposite sides of the door panels for supporting a series of rollers. The rollers travel in a pair of continuous tracks mounted on opposite sides of a door frame for guiding movement of the door panels between the vertical and horizontal positions.

Overhead garage door systems include tracks in which the garage door travels. The tracks are typically mounted to a door frame through bracket and fastener assemblies. Each door track includes a horizontal track that extends generally parallel to the garage ceiling and has an integral radius section for guiding movement of the garage door between the horizontal and vertical positions. Each door track further includes a vertical track that is mounted generally parallel to the door frame or jamb which provides a linear extension of the radius section which extends from the horizontal track. Depending on the size of the garage door opening and the available overhead room, different horizontal track radiuses are used to accommodate for different installation requirements. That is, one installation may require a ten inch radius section connected to the horizontal track while another installation may require a twelve or fifteen inch radius section. Thus, different configurations of horizontal track, i.e., with an integral ten, twelve or fifteen inch radius, for example, must be properly selected for a particular installation. Moreover, the length of the vertical track components may need to be adjusted to accommodate for lowered positioning of the horizontal track and integral radius.

Overhead doors are commonly counterbalanced with a spring assembly to assist in opening or raising of the door. Many commercial doors are very heavy, particularly insulated or wood doors, and a counterbalancing system utilizing one or more extension or torsion springs connected via cables and pulleys to the bottom section of the door is often used for this purpose. The springs and cables in such counterbalancing systems are maintained in tension and a significant amount of energy is stored in the spring to assist in lifting the door. Overtime, such springs may fail and the tension and energy stored in those springs is rapidly released which causes the overhead door system to malfunction. As such, professional installation, maintenance and periodic replacement of the counterbalancing system is often recommended.

Due to the size and weight of the overhead garage door components, and the general complexity associated with their assembly, overhead garage door systems typically are shipped by the manufacturer to a dealer for assembly at a site by a professional installer. It will be appreciated that the amount of parts which needs to be boxed and shipped by the manufacturer, as well as the length of time required for assembly of the overhead garage door system at each site, is affected by the number of components included in the overhead garage door system. Moreover, the dealer or installer must carry a greater inventory of parts as the number of unique track components in the overhead garage door system is increased.

Additionally, for garage door installations in low head room environments, various additional track components have typically been required. For example, one approach has been to provide dual parallel tracks, one above the other, with the upper track carrying the uppermost rollers of the overhead garage door. The upper track terminates close to the top of the garage door opening and thereby eliminates the need to guide the uppermost rollers below the level at which the curved portion of the track radius begins. Examples of this type of low head room track structure include U.S. Pat. Nos. 4,878,529; 4,119,133; 2,966,212; 2,436,006, and International Patent Application No. WO 96/36784.

Another approach to low head room installations has been to provide dual parallel tracks, arranged side-by-side, with one of the tracks carrying the uppermost rollers of the overhead garage door and the other track guiding the remaining rollers. Examples of this type of track system arrangement include U.S. Pat. Nos. 4,379,478; 2,064,470; and 2,045,060.

In yet another approach, as disclosed in Canadian Patent No. 657,377 and U.S. Pat. No. 1,990,870, for example, the requirement for parallel upper/lower or side-by-side tracks has been eliminated through the use of dual radius tracks mounted integrally on a corner bracket. The corner bracket includes a primary track radius that joins the horizontal and vertical track components, and an integral, auxiliary track radius that terminates near the top of the garage door opening. The auxiliary track radius guides uppermost rollers of the overhead garage door while the primary track radius guides movement of the remaining rollers between the vertical and horizontal tracks.

With this known approach, however, the primary and auxiliary track radiuses are not separable from the corner bracket, so the primary track radius cannot be used without the auxiliary track radius in normal head room installations. Moreover, in this known approach, use of the dual radius corner bracket requires the rollers extending from the side edges of the overhead garage door to be placed in a special staggered arrangement, or auxiliary rollers to be mounted to the side edges of the garage door.

One solution to many of these problems is disclosed in U.S. Pat. No. 6,047,761 (the "'761 patent"), assigned to the assignee of the present invention and hereby incorporated by reference in its entirety. The overhead door system disclosed in the '761 patent includes a pair of horizontal track members, a pair of vertical track members and a pair of primary track radius members interconnecting the horizontal and vertical track members on the opposite sides of a garage door opening. In the '761 patent, each of a pair of short radius track members extends from one of the primary track radius members to guide the uppermost rollers of an overhead sectional door. The short radius track members terminate close to the top of the door opening and thereby eliminate the need to guide the uppermost rollers below the level at which the curved portion of the track radius members begin. The universal overhead door system of the '761 patent is particularly beneficial for smaller door openings and low head room environments.

The track members in the '761 patent include so-called short radius members that are rigid and fixed for attachment to the flag bracket and the primary track radius members. The short radius track member has a generally C-shaped channel configuration in which upper and lower flanges are connected on opposite ends of a central web to capture the uppermost roller on the door. In some situations, an installer must modify or adjust the horizontal, vertical or primary track radius components to accommodate variations in the garage door opening, unlevel or non-symmetric surfaces or the like. Commonly, this requires cutting or changing the length of the vertical track member to accommodate proper installation of the short radius track. Such modifications are required and significantly labor intensive and counter productive to an efficient and quality overhead door installation process.

Accordingly, there is a need in the overhead garage door industry for an overhead door system that is modular and easily configurable to accommodate different door opening sizes, doors of different thicknesses, and in low head room environments that maximize the vertical clearance of the garage door opening and encourage pleasant and safe operation.

SUMMARY OF THE INVENTION

The present invention overcomes the foregoing and other shortcomings and drawbacks of known overhead door systems for use in low head room environments. While the invention will be described in connection with certain embodiments, it will be understood that the invention is not limited to these embodiments. On the contrary, the invention includes all alternatives, modifications and equivalents as may be included within the spirit and scope of the present invention.

In the assembly of an overhead garage door system in accordance with the principles of this invention, a pair of door tracks are formed from respective pairs of horizontal tracks, vertical tracks and track radiuses that are assembled at the installation site. A pair of horizontal rails are provided on opposite sides of the door opening to support the pair of horizontal tracks. The horizontal tracks, vertical tracks and track radiuses guide movement of the overhead garage door between the horizontal and vertical positions.

To accommodate for different door opening sizes and low head room environments, a pair of short radius track members are provided to be interconnected with the door tracks of the overhead garage door system. In particular, the overhead garage door system includes respective pairs of horizontal tracks, vertical tracks and track radiuses that are assembled to form a pair of door tracks mounted on opposite sides of the overhead garage door. The pair of track radiuses include openings which permit uppermost rollers of the overhead garage door to travel outside of the door tracks during movement of the garage door to the vertical or closed position. The adjustable short radius members are mounted to extend from the openings in the track radiuses for guiding movement of the uppermost rollers into and out of the track radiuses during movement of the overhead garage door between the horizontal and vertical positions. The adjustable short radius members terminate close to the top of the garage door opening and thereby eliminate the need to guide the uppermost rollers below the level at which the curved portion of the track radiuses begin. A pair of guide rollers are connected to the respective pair of uppermost rollers for carrying the uppermost rollers through the openings in the track radiuses during movement of the overhead garage door between the vertical and horizontal positions.

In accordance with one aspect of the present invention, the short radius members are adjustable in curvature by hand to accommodate various installation requirements and vagaries of door openings and environments without the need for an inventory of multiple sizes or configurations of components or on site cutting of standard components.

In one embodiment of the present invention, the adjustable short radius member have a pair of V-shaped notches formed therein so that the curvature of the adjustable short radius member may be adjusted by bending of the short radius members. Additionally, an upper flange of the adjustable short radius track member includes an upturned detent to provide a stop for the guide roller riding along the upper flange of the adjustable short member.

In accordance with another aspect of the present invention, stationary sheaves are displaced from the door opening and are positioned in slots formed in a flange of a horizontal angle rail by means of a sheave bracket. This allows for the garage door to be raised so as to maximize vertical clearance while still providing that the lift cable will be closely aligned with the door tracks.

In accordance with another aspect of the present invention, a spacer is provided on a moveable sheave for use when a long horizontal angle rail is required in an extension spring system. A groove in the spacer may ride along an edge of the flange of the horizontal angle rail or on top of the flange to prevent contact of the moveable sheaves with the horizontal rails.

The above features and advantages of this invention will be better understood with reference to the accompanying figures and detailed description.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE INVENTION

Figure 1:
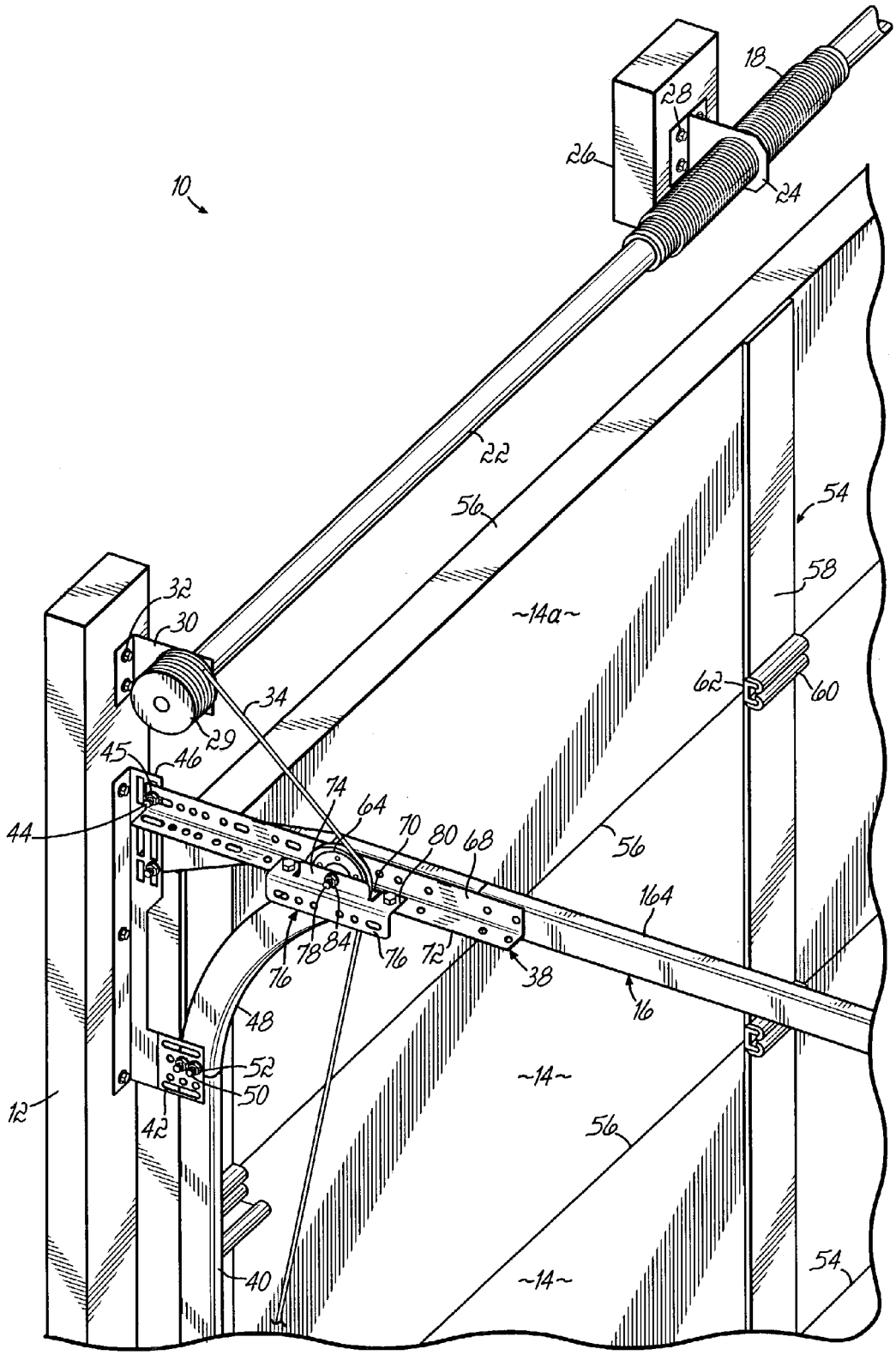
FIG. 1 is a partial perspective view of an overhead door system in accordance with one embodiment of the present invention utilizing a torsion spring for counterbalancing the overhead sectional door.

With reference to the Figures, and to FIG. 1 in particular, a low head room overhead door system 10 is shown in accordance with the principles of the present invention. The low head room overhead door system 10 includes a conventional door frame 12 that defines an opening into a garage, and a series of interconnected door panels 14 that articulate between a vertical position as shown if FIG. 1 and an overhead, horizontal position not shown. Door tracks 16 (one shown) are located on either side of the door panels for guiding movement of the door panels between the horizontal and vertical positions. While only one door track 16 is shown in FIG. 1, it will be appreciated that the other door track located on the opposite side of door panels mirrors the track 16 shown and is otherwise identical in construction.

Figure 2:
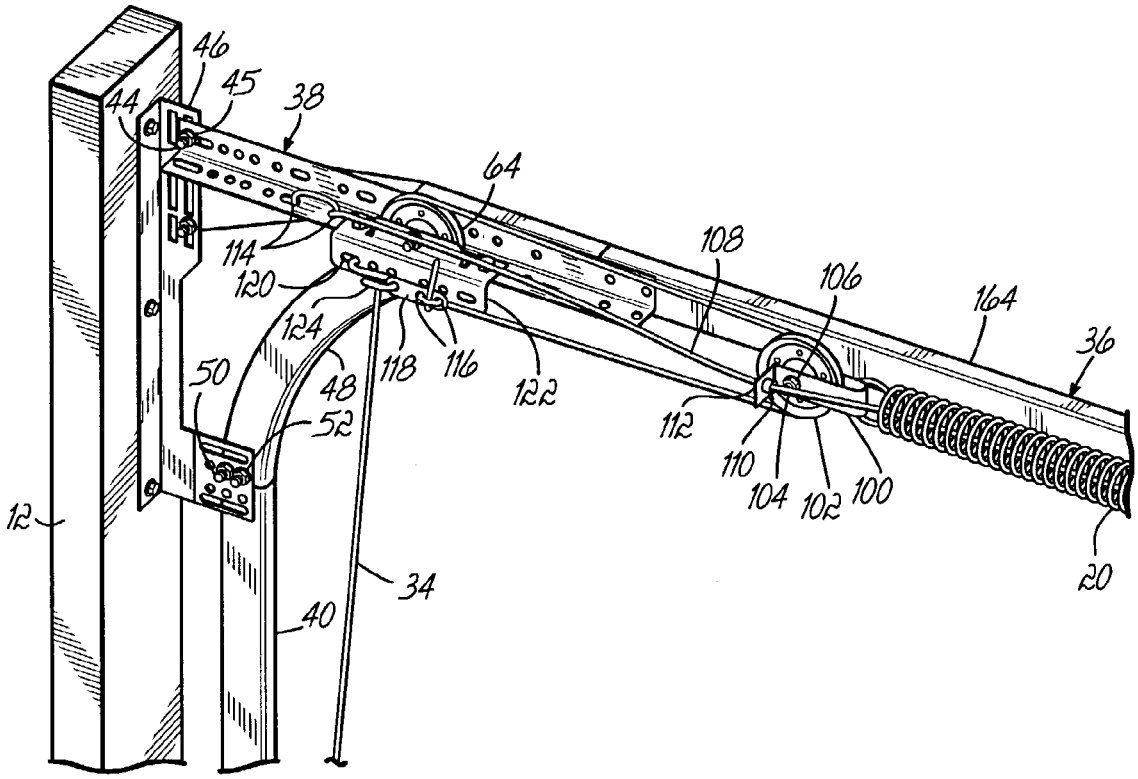
FIG. 2 is a partial perspective view of an alternative embodiment of the present invention utilizing an extension spring for counterbalancing the overhead sectional door.

The present invention may utilize either a torsion spring 18, as shown in FIG. 1, or a plurality of extension springs 20, one of which is shown in FIG. 2, to counterbalance the weight of the door panels 14 and thus ease the movement of the interconnected door panels 14 between the vertical and horizontal positions. When a torsion spring 18 is used, it is wound around a torsion shaft 22 which is supported by a center bearing plate 24. The center bearing plate 24 is attached to stationary torsion spring cones with hex head bolts and nuts. The center bearing plate 24 is attached to the spring anchor pad 26 with fasteners 28.

Attached to either end of the torsion shaft 22 is a cable drum 29 (one shown). The cable drums 29 are placed outboard of the end bearing plates 30 (one shown) with the set screws (not shown) facing out. The end bearing plates 30 are attached to the door frame 12 with suitable bolts or fasteners 32. Lift cables 34 (one shown) are attached to and wound around the cable drums 28.

The door tracks 16 preferably include horizontal tracks 36 (one shown) that are supported by horizontal angle rails 38 (one shown), and vertical tracks 40 (one shown) mounted to door frame 12 through jamb brackets 42. Carriage bolts 44 and flange nuts 45 are used to secure the horizontal angle rails 38 to flag brackets 46 which are attached to opposite sides of the door frame 12. Track radiuses 48 are preferably mounted at opposite ends to the horizontal rails 36 and jamb brackets 42. Track bolts 50 and flange nuts 52 are used to fasten the track radiuses 48 to the jamb brackets 42. The track radiuses 48 form extensions of the horizontal tracks 36 and the vertical tracks 40. Alternatively, it will be appreciated that the track radiuses 48 may be formed integrally with the horizontal tracks 36 without departing from the spirit and scope of the present invention.

With further reference to FIG. 1, each of the door panels 14 includes a series of vertically aligned and spaced door stiles 54 that extend between longitudinal edges 56 of each door panel 14. The door stiles 54 are pivotally interconnected to permit movement of the door panels 14 between the vertical and horizontal positions. The door stiles 54 may be formed of metal and include a generally planar web 58 and a pair of spaced transverse legs (not shown) which extend partially along opposite sides of the stiles 54. At each end of the door stiles 54, a hinge mount 60 is provided to slidably receive and support a portion of a living hinge 62 within the hinge mount. In this way, the living hinges 62 are located at the joints 56 between the adjacent door panels 14 and are supported by pairs of hinge mounts 60 at the adjacent ends 56 of the door stiles 54. By way of example, details of the construction and operation of living hinges may by found in U.S. Pat. Nos. 4,995,441; 5,054,536; and 5,129,441, all assigned to the assignee of this invention, and all of which are incorporated herein by reference in their entirety. Of course, it will be appreciated that other hinge structures are possible as well without departing from the spirit and scope of the present invention.

As shown in FIGS. 1 and 2, a stationary sheave 64, around which the lift cable 34 is wrapped, is laterally displaced from the door panels 14 and the opening of the garage door (not shown) on opposite sides of the door panels. Since the bottom end 66 of the lowest door panel 14 cannot be raised beyond the position of the stationary sheave 64, offsetting the stationary sheave 64 from the door panels 14 and the door opening allows even the lowest door panel 14 to be positioned in a substantially horizontal position when the garage door is opened, thus allowing for greater vertical clearance.

In a standard head room door assembly (not shown), the stationary sheave 64 is positioned adjacent the flag bracket 46 and mounted inboard of the to the interior vertical side 68 of the horizontal angle rail 38. However, to facilitate additional vertical clearance in the low head room door system 10 of the present invention, the stationary sheave 64 is moved away from the flag bracket 46 and is unable to be mounted on the interior vertical side 68 of the horizontal angel rail 38 due to the presence at that point of the horizontal track 38. Accordingly, as shown in FIGS. 1–4 the stationary sheave 64 is position in a cut-out area or slot 70 formed in a flange 72 of the horizontal angle rail 36. This allows the stationary sheave 64 to be positioned as close to the track 16 as possible in a low head room door assembly to promote better alignment, lift efficiency, and minimize wear. Additionally, the placement of the stationary sheave 64 in the slot 70 provides for an increase in the safety of the overhead door system 10 should the lift cable 34 become dislodged from the stationary sheave 64. By positioning the stationary sheave 64 in the slot 70 formed in the flange 72 of the horizontal angle rail 38, the lift cable 34 will be restrained in the slot 70 in the event the lift cable 34 should ever inadvertently come off of the stationary sheave 64.

Figure 4:
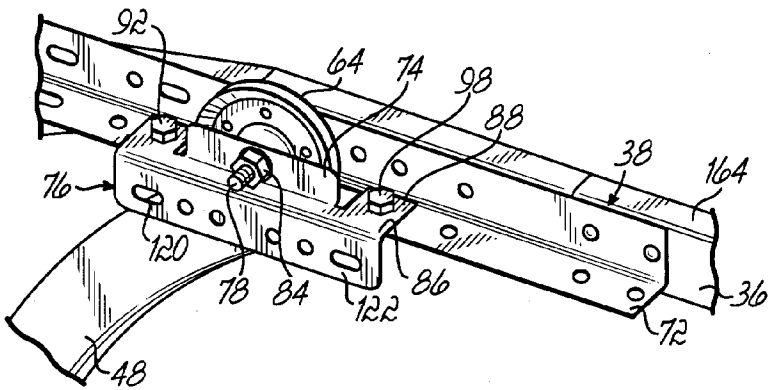
FIG. 4 is an assembled perspective view of the fixed sheave shown in FIG. 3.
Figure 3:
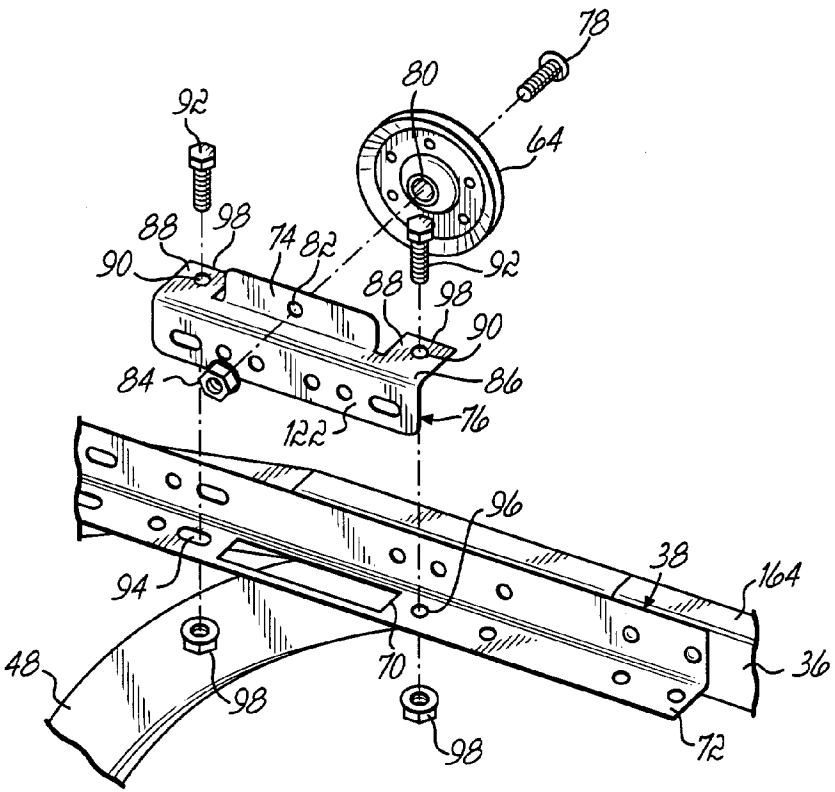
FIG. 3 is an exploded partial perspective view showing mounting of a fixed sheave in the overhead door systems of FIGS. 1 and 2.

As shown in FIGS. 3 and 4, the stationary sheave 64 is mounted to an upper vertical wall 74 of a sheave bracket 76 by a pan head sheave bolt 78 which passes through an aperture 80 formed in the stationary sheave 64 and an aperture 82 formed in the upper vertical wall 74 of a sheave bracket 76 and is threaded to a flange nut 84. The sheave bracket 76 is designed to work with either a 3" or 4" diameter sheave 64. A horizontal portion 86 of the sheave bracket 76 has a pair of arms 88 extending from it, each containing an aperture 90. Two hex head bolts 92 extend through apertures 90 formed in the arms 88 of the horizontal portion 86 of the sheave bracket 76 and through apertures 94, 96 formed in the flange 72 of the horizontal angle rail 38 and are threaded to two flange nuts 98. One of the apertures 94 may be oblong, thus improving the alignability of the apertures 90 with the apertures 94, 96 in the flange 72 of the horizontal angle rail 38.

The apertures 90 are positioned closer to the ends 98 of the arms 88 for a 4" stationary sheave 64 than for a 3" stationary sheave 64. Alternatively, a two-position aperture (not shown) in the arms 88 of the horizontal ledge 86 of the sheave bracket 76 may be employed that will also allow sheave bracket 76 to be secured at different distances from the vertical wall 68 of the horizontal angle rail 38 depending on the size of the diameter of the stationary sheave 64 used.

FIG. 2 shows an alternative embodiment of the present invention utilizing extension springs 20 (one shown). While only one extension spring 20 is shown in FIG. 2, it will be appreciated that a mirror image of the configuration shown in FIG. 2 will be located on the opposite side of garage door opening and is otherwise identical in construction. In addition, two extension springs 20 can be used on each side of the garage door opening for applications where a heavy garage door is used and requires additional counterbalancing. When using a double spring low head room assembly, it is preferable to position one spring above and one spring below the flange 72 of the horizontal angle rail 38.

As shown in FIGS. 2 and 8–11, the extension springs 20 are attached to a sheave fork 100 which is attached to a movable sheave 102 by a hex head bolt 104 and hex nut 106. A guide cable 108 runs through an aperture 110 of a flange 112 of the sheave fork 100 and longitudinally through the extension springs 20. The guide cable 108 is secured through other apertures 114 in the flange 72 of the horizontal angle rail 38 which are located between the sheave bracket 74 and the flag bracket 46.

The lift cable 34 is routed around the stationary sheave 64 and around the moveable sheave 102 and is then tied and secured through two apertures 116 formed in a clip 118. The clip 118 is then secured to an oblong aperture 120 in the lower vertical wall 122 of the sheave bracket 76 by means of an "S" hook 124.

Figure 5:
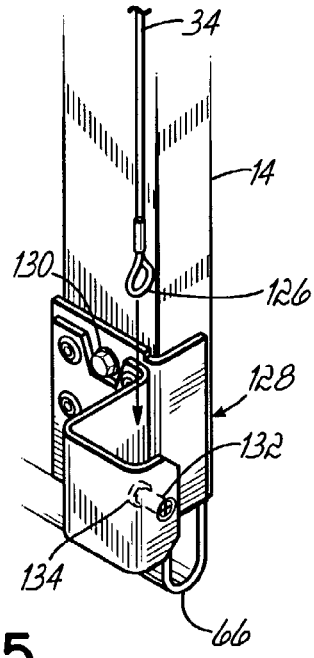
FIG. 5 is a partial perspective view showing mounting of a bottom bracket to the bottom of the sectional door panels shown in FIG. 1.

As shown in FIG. 5, the loop end 126 of the lift cable 34 that is opposite the end of the lift cable 34 that is wound around the cable drums 28 in a torsion spring 18 configuration as shown in FIG. 1, or the end of the lift cable 34 that is tied to the clip 118 in an extension spring 20 configuration as shown in FIG. 2, is attached to safety bottom brackets 128 which are attached to the bottom section of the lowest door panel 14. The safety bottom brackets are secured to the lowest door panel 14 of steel doors with sheet metal screws and to the lowest door panel 14 of wood doors with carriage bolts 130 and nuts. A clevis pin 132 passes through an aperture 134 in the safety bottom bracket 128 and through the loop end 126 of the lift cable 34 and is secured by a cotter pin (not shown).

Figure 6:
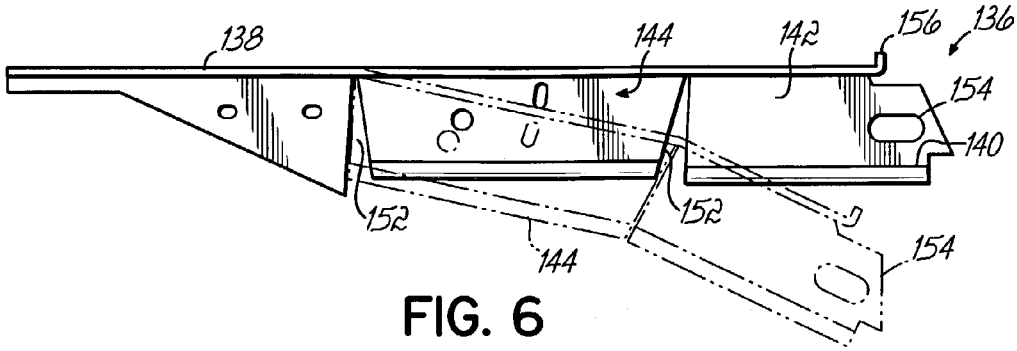
FIG. 6 is a side elevational view of an adjustable short radius member in accordance with the principles of the present invention.
Figure 7:
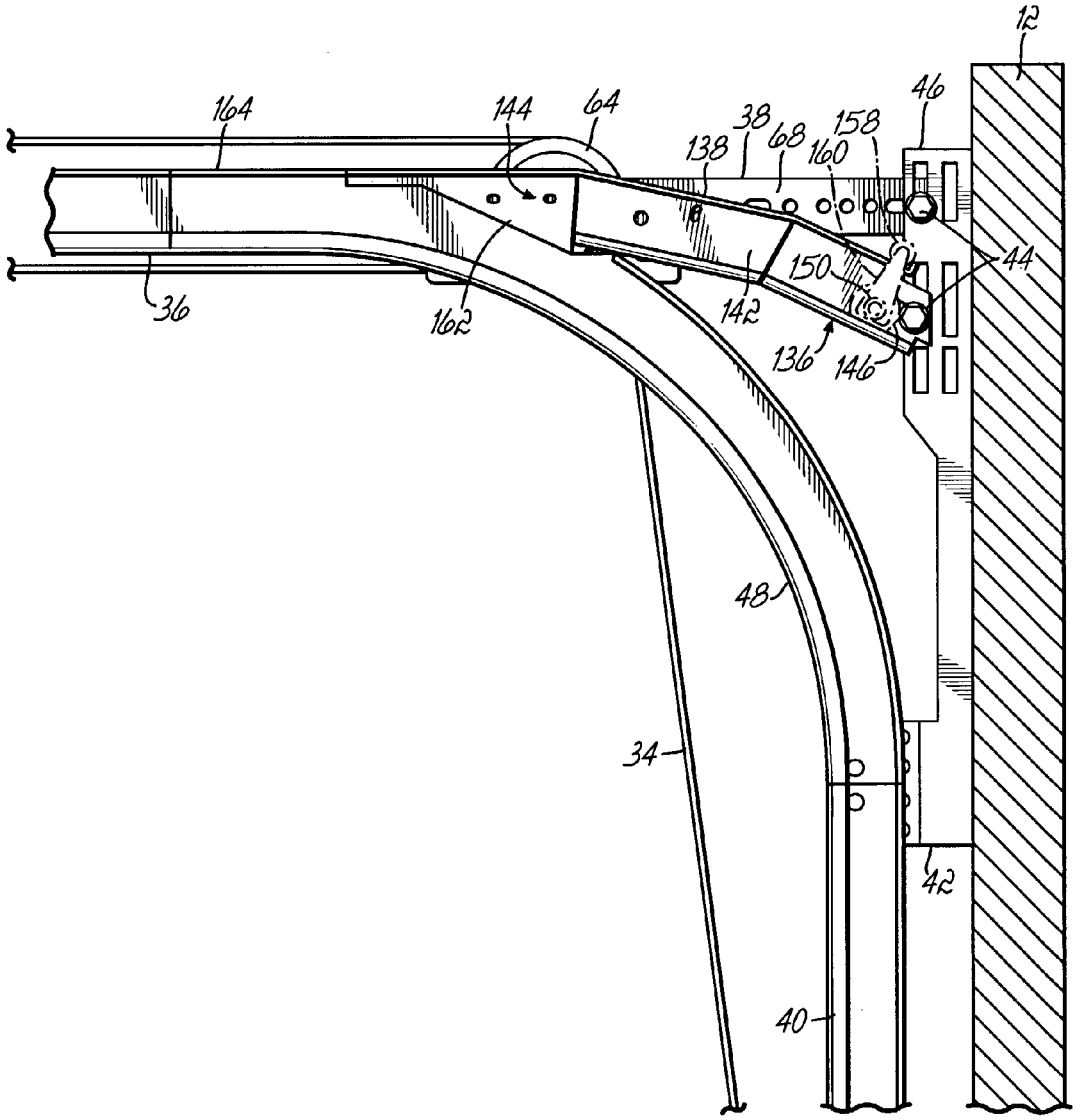
FIG. 7 is a side view of the adjustable short radius member shown in FIG. 6 installed in the overhead door system of FIG. 2.
Figure 8:
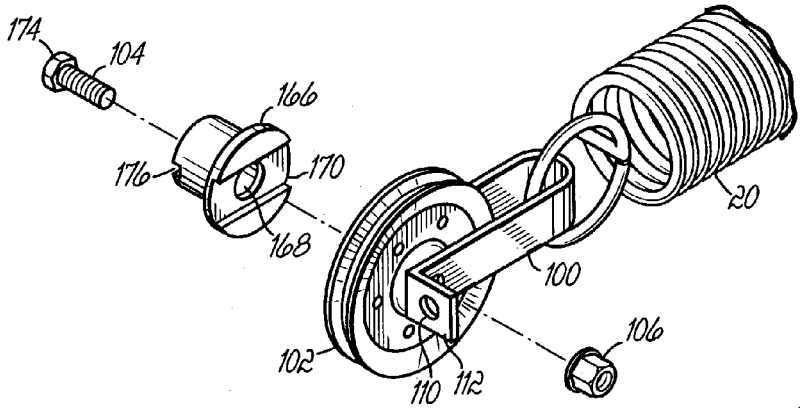
FIG. 8 is an exploded perspective view of a movable sheave and spacer assembly used in the overhead door system of FIG. 2.

FIGS. 6 and 7 show an adjustable short radius member 136, and as in FIGS. 1 and 2, the mirror image of which would be installed on the opposite side of the garage door opening. Preferably, the adjustable short radius members 136 are channel-shaped having an upper flange 138, a lower flange 140 and a web 142 that define channels 144 for guiding uppermost rollers 146 (one shown in phantom). The uppermost rollers 146 are mounted to the uppermost door panel 149 (FIG. 1) through axles 150. Preferably, the adjustable short radius members 136 have an adjustable radius of curvature over a range which are all greater than the track radiuses 48.

The adjustable short radius members 136 are adjustable through a pair of V-shaped notches 152 formed in the web 142 and the lower flange 140 so that the radius of curvature of the adjustable short radius track members 136 may be adjusted by bending the adjustable short radius track members 136 about the upper continuous flange 138 to thereby increase or decrease the opening in the web 142 and the lower flange 140 at the V-shaped notch 152 locations. It will be appreciated that other mechanisms can also be employed to provide adjustment of the radius of the adjustable short radius members 136 without departing from the spirit and scope of the present invention.

The ends of the adjustable short radius members 136 that are bolted to the flag brackets 46 proximate the door opening include an oval-shaped hole 154 to accommodate the various configurations of the adjustable short radius member 136 while still providing appropriate access for bolting or securing the adjustable short radius members 136 to the flag brackets 46. The adjustable short radius members 136 are mounted to the flag brackets 46 with carriage bolts 44 and flange nuts 45. Additionally, the upper flanges 138 of the adjustable short radius members 136 include an upturned detent 156 to provide a stop for guide rollers 158 which are attached via a linkage member 160 to the axles 150 of the uppermost rollers 146. The use of the detent 156 is particularly important when thicker door panels 14 are used to form a stop for the guide rollers 158 near a gap that is formed between the ends of the short radius members 136 and the thicker door panels 14 through which the guide roller 158 may otherwise fall.

As shown in FIG. 7, the track radiuses 48 have an opening 162 that permits the uppermost rollers 146 (one shown in phantom) to travel outside of the track radiuses 48 as the door panels 14 move to the vertical or closed position. In operation, as the door panels 14 move to the vertical or closed position, the channels 144 of the adjustable short radius members 136 receive and guide the uppermost rollers 146. As the door panels 14 move to the horizontal or open position, the channels 144 of the adjustable short radius members 136 guide the uppermost rollers 146 through the openings 162 in the track radiuses 48 to travel it travel within the track radiuses 48 and the horizontal tracks 36 of the door tracks 16.

The guide rollers 158 travel along the upper flanges 164 of the horizontal tracks 36 and track radiuses 48 during partial movement of the door panels 14, and along the upper flanges 138 of the adjustable short radius members 136 during the phase of the movement of the door panels 14 that occurs immediately before or after the door panels 14 are in their vertical or closed position. Thus, as the door panels 14 move to the vertical or closed position, the guide rollers 158 transition from the upper flanges 164 of the horizontal tracks 36 and track radiuses 48 to the upper flanges 138 of the adjustable short radius members 136 near the point where the uppermost rollers 158 travel through the openings 162 in the track radiuses 48. As the guide rollers 146 travel along the upper flanges 138 of the adjustable short radius members 136, the linkage members 160 carry the uppermost rollers 146 through the channel 144 in the adjustable short radius members 136. Likewise, as the door panels 14 move to the horizontal or open position, the guide rollers 158 transition from the upper flanges 138 of the adjustable short radius members 136 to the upper flanges 164 of the horizontal tracks 36 and track radiuses 48 near the point where the uppermost rollers 140 travel through the opening 162 in the track radiuses 48.

The ability for an installer to accommodate vagaries in a particular installation environment or door frame 12 by adjusting the curvature and shape of the adjustable short radius track member 136 provides a significant advantage in the manufacturing, inventory storage and installation process.

When extension springs 20 are used and a horizontal angle rail 38 is longer than 22" is used, such as may be the case when additional support is required such as for double car door widths, a spacer 166, as shown in FIGS. 8–11, is attached to the sheave fork 100. The spacer 166, which is typically made of plastic, prevents the metal-to-metal contact that would otherwise occur between the sheave fork 100 and the longer horizontal angle rail 38. Preventing this metal-to-metal contact reduces the noise of the operation of the door, reduces the wear of the sheave fork 100 and contributes to the overall safety of the system 10.

Figure 11:
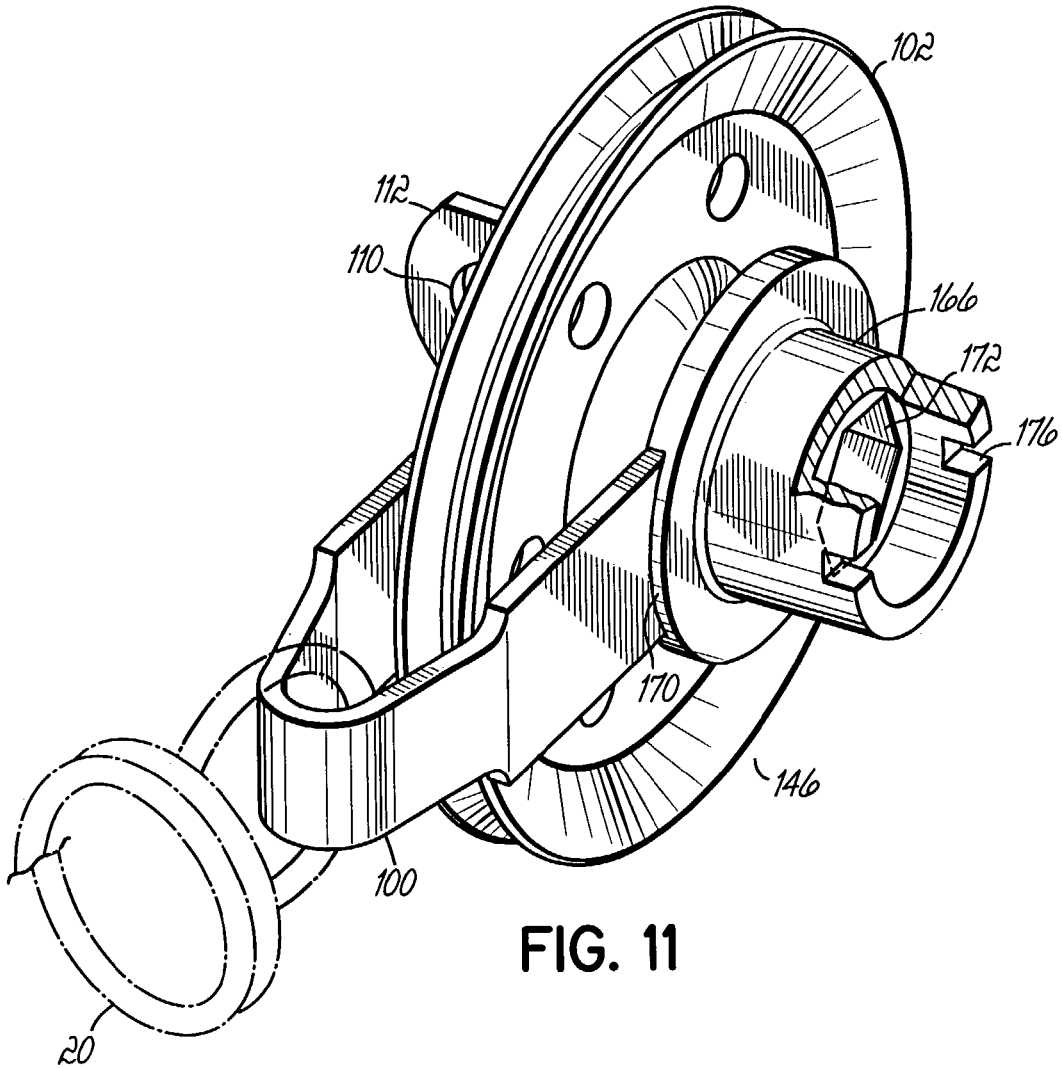
FIG. 11 is an enlarged view showing details of the movable sheave and spacer assembly of FIGS. 8–10.

The spacer 166 has an aperture 168 through which a hex head bolt 104 passes and is secured on the opposite side of the movable sheave 102 and sheave fork 100 by a hex nut 106. The spacer 166 also contains a notch 170 which captures a portion of the sheave fork 100 within the notch 170 to thereby prevent the spacer 166 from rotating. It is important to prevent the rotation of the spacer 166 since if it rotates, it could possibly also rotate the hex bolt 104 causing it to disassemble from the hex nut 106. As is shown in FIG. 11, the spacer 166 also contains a molded-in matching hex bolt profile 172. The head 174 of the hex bolt 104 is received in the molded-in hex bolt profile 172 and thus cannot rotate when the hex nut 106 is being installed. This also eliminates the need for a tool to keep the hex bolt 104 from turning during installation.

Figure 9:
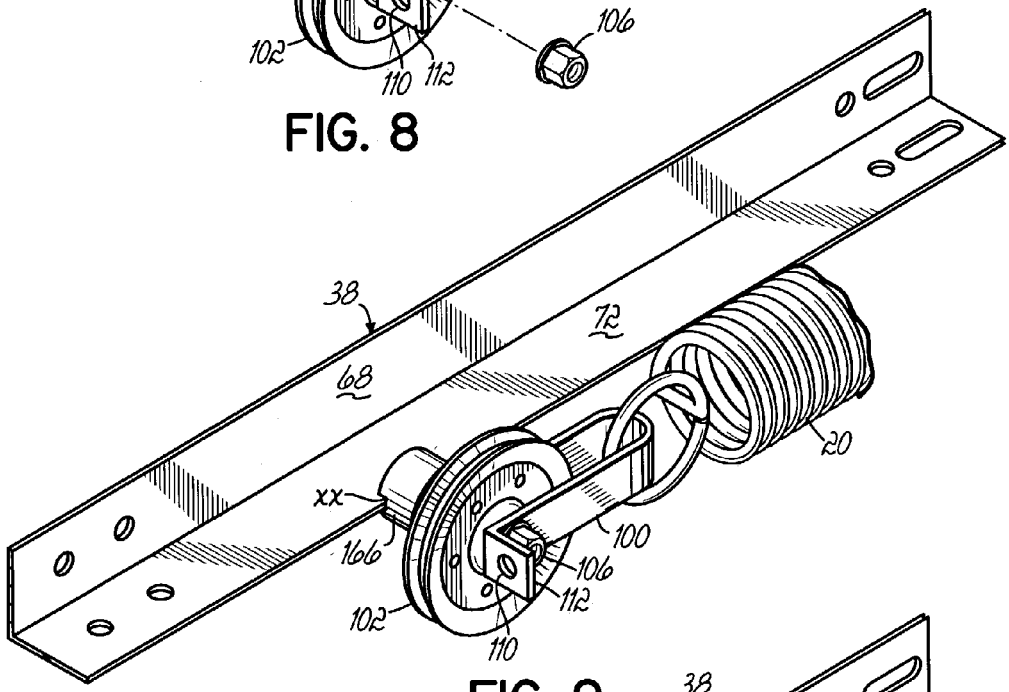
FIG. 9 is a perspective view of the movable sheave and spacer assembly of FIG. 8 showing mounting of the movable sheave and spacer assembly to a horizontal rail flange in the overhead door system of FIG. 2.
Figure 10:
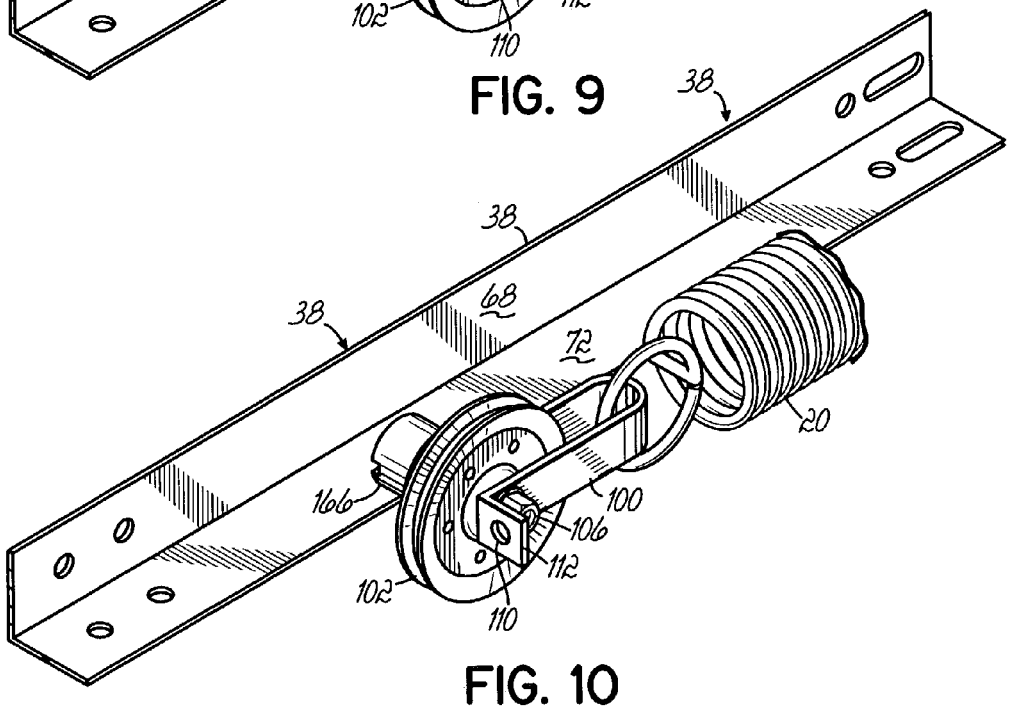
FIG. 10 is a perspective view of the movable sheave and spacer assembly of FIG. 8 showing an alternative mounting of the movable sheave and spacer assembly to the horizontal rail flange.

The spacer 166 has a groove 176 that allows it to ride, as shown in FIG. 9, like a monorail along the edge 178 of the flange 72 of the horizontal angle rail 38. This configuration is often desirable when duel extensions springs 20 are used on the same side of a garage door opening. Alternatively, as shown in FIG. 10, the spacer 166 can ride along the top surface 180 of the flange 72 of the horizontal angle rail 38.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicants' general inventive concept.

Having described the invention, what is claimed is:

1. An overhead door system, comprising:

an overhead door having a plurality of pivotally interconnected door panels operable to move between vertical and horizontal positions relative to a door frame, each of said door panels having guide members arranged on opposite sides thereof;

a support rail mounted to and extending generally horizontally from a side of said door frame;

a pair of generally channel-shaped horizontal track members each defining a generally horizontal channel for guiding movement of said guide members;

a pair of generally channel-shaped vertical track members mounted respectively to opposite sides of said door frame, each of said vertical track members defining a generally vertical channel for guiding movement of said guide members;

a pair of generally channel-shaped radius track members extending in a defined radius of curvature to join respective ends of said vertical track members to respective ends of said horizontal track members and thereby form a pair of substantially continuous door tracks on opposite sides of said door frame, each of said radius track members defining a curved channel for guiding movement of said guide members between said horizontal and vertical channels;

wherein the support rail is coupled to one of the horizontal, vertical and radius track members;

a counterbalancing system coupled to the overhead door to assist in moving the door from the vertical position toward the horizontal position;

a stationary sheave positioned a spaced distance from the door frame;

a cable coupled to the overhead door and the counterbalancing system and routed on the stationary sheave;

a slot formed in said support rail and said cable is routed through said slot;

wherein said stationary sheave is positioned within said slot.

2. The overhead door system of claim 1 wherein each of said radius members further having an opening to permit uppermost ones of said guide members on opposite sides of said overhead door to travel outside of said curved channels; and a pair of generally channel-shaped second radius members, each of said second radius members having a perimeter and a first end and a second end, each of said second radius members defining a second curved channel coupled to the opening in said curved channels for guiding movement of said uppermost guide members into and out of said curved channels during movement of said overhead door between said vertical and horizontal positions;

wherein a configuration of said second radius members is vertically adjustable between a first installed configuration where said second end is vertically level with said first end and a plurality of other installed configurations wherein said second end is positioned vertically lower than said first end, whereby varying the vertical position of said second end will vary the radius of an arc defined by said other installed configurations.

3. The overhead door system of claim 2 wherein each of said second radius members includes a notch formed therein, said notch having an open end at said perimeter of said second radius member and a distal end opposite said open end, said notch adapted to permit pivotal bending of said second radius members at said distal end.

4. The overhead door system of claim 3 wherein in said first installed configuration said notch is V-shaped having two straight sides respectively extending uninterruptedly from said open end and connecting at said distal end, said notch adapted to allow said two straight sides to be brought completely together in one of said other installed configurations.

5. The overhead door system of claim 2 wherein each of said second radius members comprises:

an upper flange;

a lower flange;

a web connecting the upper and lower flanges;

wherein said notch cuts completely through said lower flange and said web connecting the upper and lower flanges so that the unity of said second radius member is maintained solely by said upper flange.

6. The overhead door system of claim 5 wherein said upper flange includes an upturned detent integral with said upper flange.

7. The overhead door system of claim 1 wherein the counterbalancing system includes an extension spring, the overhead door system further comprising:

a moveable sheave coupled to the extension spring and positioned adjacent said support rail; and a spacer member operatively connected to said moveable sheave and operable to guide said moveable sheave in relation to said support rail.

8. The overhead door system of claim 2 further comprising:

a detent on and integral with each of the second radius members.

9. The overhead door system of claim 2 wherein the guide members further comprise rollers captured for movement in selected ones of the horizontal, vertical, radius and second radius members, the overhead door system further comprising:

a guide roller coupled to the uppermost guide member roller for travel outside of the curved channels.

10. The overhead door system of claim 9 further comprising:

a detent on and integral with each of the second radius members adapted to restrain movement of the guide roller.

11. The overhead door system of claim 2 wherein an attachment position of each second radius member relative to the door frame is adjustable.

12. The overhead door system of claim 2 wherein a radius of curvature of each second radius member is adjustable and the radius of curvature of each first radius members is fixed.

13. An overhead door system, comprising:

an overhead door having a plurality of pivotally interconnected door panels operable to move between vertical and horizontal positions relative to a door frame, each of said door panels having guide members arranged on opposite sides thereof;

a support rail mounted to and extending generally horizontally from a side of said door frame;

a pair of generally channel-shaped horizontal track members each defining a generally horizontal channel for guiding movement of said guide members;

a pair of generally channel-shaped vertical track members mounted respectively to opposite sides of said door frame, each of said vertical track members defining a generally vertical channel for guiding movement of said guide members;

a pair of generally channel-shaped radius track members extending in a defined radius of curvature to join respective ends of said vertical track members to respective ends of said horizontal track members and thereby form a pair of substantially continuous door tracks on opposite sides of said door frame, each of said radius track members defining a curved channel for guiding movement of said guide members between said horizontal and vertical channels;

wherein the support rail is coupled to one of the horizontal, vertical and radius track members;

a counterbalancing system coupled to the overhead door to assist in moving the door from the vertical position toward the horizontal position;

wherein the counterbalancing system includes an extension spring;

a stationary sheave positioned a spaced distance from the door frame;

a cable coupled to the overhead door and the counterbalancing system and routed on the stationary sheave;

a slot formed in said support rail and said cable is routed through said slot;

a moveable sheave coupled to the extension spring and positioned adjacent said support rail;

a spacer member operatively connected to said moveable sheave and operable to guide said moveable sheave in relation to said support rail; and a groove on the spacer adapted to engage an edge of the support rail therein for guiding movement of the spacer and moveable sheave relative to the support rail.

14. The mounting system of claim 13 wherein the counterbalancing system includes an extension spring, the mounting system further comprising:

a moveable sheave coupled to the extension spring and positioned adjacent said support rail; and a spacer member operatively connected to said pair of moveable sheave and operable to guide said moveable sheave in relation to said support rail.

15. The mounting system of claim 14 further comprising:

a groove on the spacer adapted to engage an edge of the support rail therein for guiding movement of the spacer and moveable sheave relative to the support rail.

16. A mounting system for an overhead door having a plurality of pivotally interconnected door panels operable to move between vertical and horizontal positions relative to a door frame, each of said door panels having guide members arranged on opposite sides thereof, the mounting system comprising:

a support rail mounted to and extending generally horizontally from a side of said door frame;

a pair of generally channel-shaped horizontal track members defining a generally horizontal channel for guiding movement of said guide members;

a pair of generally channel-shaped vertical track members mounted respectively to opposite sides of said door frame, each of said vertical track members defining a generally vertical channel for guiding movement of said guide members;

a pair of generally channel-shaped radius track members extending in a defined radius of curvature to join respective ends of said vertical track members to respective ends of said horizontal track members and thereby form a pair of substantially continuous door tracks on opposite sides of said door frame, each of said radius track members defining a curved channel for guiding movement of said guide members between said horizontal and vertical channels;

wherein the support rail is coupled to one of the horizontal, vertical and radius track members;

a counterbalancing system coupled to the overhead door to assist in moving the door from the vertical position toward the horizontal position;

a stationary sheave positioned a spaced distance from the door frame;

a cable coupled to the overhead door and the counterbalancing system and routed on the stationary sheave;

a slot formed in said support rail and said cable is routed through said slot;

wherein said stationary sheave is positioned within said slot.

17. The mounting system of claim 16 further comprising;

an opening in each of the radius track members to permit uppermost ones of the guide members on opposite sides of the overhead door to travel outside of the curved channels; and a pair of generally channel-shaped second radius members, each of said second radius members having a perimeter and a first end and a second end, each of the second radius members defining a second curved channel coupled to the opening in the curved channels for guiding movement of the uppermost guide members into and out of the curved channels during movement of the overhead door between the vertical and horizontal positions;

wherein a configuration of the second radius members is vertically adjustable between a first installed configuration where said second end is vertically level with said first end and a plurality of other installed configurations wherein said second end is positioned vertically lower than said first end, whereby varying the vertical position of said second end will vary the radius of an arc defined by said other installed configurations.

18. The mounting system of claim 17 wherein each of the second radius members includes a notch formed therein, said notch having an open end at said perimeter of said second radius member and a distal end opposite said open end, said notch adapted to permit pivotal bending of the second radius member at said distal end.

19. The mounting system of claim 18 wherein in said first installed configuration the notch is V-shaped having two straight sides respectively extending uninterruptedly from said open end and connecting at said distal end, said notch adapted to allow said two straight sides to be brought completely together in one of said other installed configurations.

20. The mounting system of claim 17 wherein each of the second radius members comprises:

an upper flange;

a lower flange; and a web connecting the upper and lower flanges;

wherein said notch cuts completely through said lower flange and said web connecting the upper and lower flanges so that the unity of said second radius member is maintained solely by said upper flange.

21. The mounting system of claim 17 further comprising:

a detent on and integral with each of the second radius members adapted to restrain movement of one of the guide members.

22. The mounting system of claim 17 wherein an attachment position of each second radius member relative to the door frame is adjustable.

23. The mounting system of claim 17 wherein a radius of curvature of each second radius member is adjustable and the radius of curvature of each of the other radius members is fixed.

24. A mounting system for an overhead door having a plurality of pivotally interconnected door panels operable to move between vertical and horizontal positions relative to a door frame, each of said door panels having guide members arranged on opposite sides thereof, the mounting system comprising:

a support rail mounted to and extending generally horizontally from a side of said door frame;

a pair of generally channel-shaped horizontal track members defining a generally horizontal channel for guiding movement of said guide members;

a pair of generally channel-shaped vertical track members mounted respectively to opposite sides of said door frame, each of said vertical track members defining a generally vertical channel for guiding movement of said guide members;

a pair of generally channel-shaped radius track members extending in a defined radius of curvature to join respective ends of said vertical track members to respective ends of said horizontal track members and thereby form a pair of substantially continuous door tracks on opposite sides of said door frame, each of said radius track members defining a curved channel for guiding movement of said guide members between said horizontal and vertical channels;

wherein the support rail is coupled to one of the horizontal, vertical and radius track members;

a counterbalancing system coupled to the overhead door to assist in moving the door from the vertical position toward the horizontal position;

wherein the counterbalancing system includes an extension spring;

a stationary sheave positioned a spaced distance from the door frame;

a cable coupled to the overhead door and the counterbalancing system and routed on the stationary sheave;

a slot formed in said support rail and said cable is routed through said slot;

a moveable sheave coupled to the extension spring and positioned adjacent said support rail;

a spacer member operatively connected to said moveable sheave and operable to guide said moveable sheave in relation to said support rail; and a groove on the spacer member adapted to engage an edge of the support rail therein for guiding movement of the spacer and moveable sheave relative to the support rail.

* * * * *